US006336872B1

(12) United States Patent
Moriyama et al.

(10) Patent No.: US 6,336,872 B1
(45) Date of Patent: Jan. 8, 2002

(54) MULTI-PIECE SOLID GOLF BALL

(75) Inventors: Keiji Moriyama; Takashi Sasaki, both of Akashi; Takeshi Asakura, Fukuchiyama; Satoshi Iwami, Akashi, all of (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/472,892

(22) Filed: Dec. 28, 1999

(30) Foreign Application Priority Data

Dec. 28, 1998 (JP) ..... 10-372759

(51) Int. Cl.[7] ..... A63B 37/06
(52) U.S. Cl. ..... 473/374
(58) Field of Search ..... 473/373, 374, 473/367, 368, 370–371

(56) References Cited

U.S. PATENT DOCUMENTS

| | | | | |
|---|---|---|---|---|
| 5,253,871 | A | | 10/1993 | Viollaz |
| 5,439,227 | A | | 8/1995 | Egashira et al. |
| 5,556,098 | A | | 9/1996 | Higuchi et al. |
| 5,704,854 | A | | 1/1998 | Higuchi et al. |
| 5,830,085 | A | * | 11/1998 | Higuchi et al. ..... 473/373 |
| 5,830,087 | A | | 11/1998 | Sullivan et al. |

FOREIGN PATENT DOCUMENTS

| | | |
|---|---|---|
| GB | 2302330 | 1/1997 |
| JP | 4244174 | 9/1992 |
| JP | 2570587 | 10/1996 |
| JP | 910357 | 1/1997 |
| JP | 910358 | 1/1997 |
| JP | 9117532 | 5/1997 |
| JP | 2658811 | 6/1997 |
| JP | 9313643 | 12/1997 |

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

The present invention provides a multi-piece solid golf ball having excellent flight performance and good shot feel at the time of hitting. The present invention relates to a multi-piece solid golf ball comprising a center having at least one layer, an intermediate layer formed on the center, and an outer layer covering the intermediate layer, wherein the center has a JIS-C hardness of 65 to 85, a surface hardness of the center is higher than a central point hardness of the center by not more than 10, a JIS-C hardness of the intermediate layer is lower than the surface hardness of the center by 0 to 10, a JIS-C hardness of the outer layer is higher than the hardness of the intermediate layer by 15 to 40.

8 Claims, 1 Drawing Sheet

MULTI-PIECE SOLID GOLF BALL

FIELD OF THE INVENTION

The present invention relates to a multi-piece solid golf ball. More particularly, it relates to a multi-piece solid golf ball having excellent flight performance and good shot feel at the time of hitting.

BACKGROUND OF THE INVENTION

Many types of golf balls are commercially selling, but they are typically classified into solid golf balls such as two-piece golf balls, three-piece golf balls and thread wound golf balls. The solid golf balls generally occupy the greater part of the golf ball market, because they inherently have longer flight distance than the thread wound golf balls and have been improved to have soft and good shot feel at the time of hitting as good as the thread wound golf ball. The three-piece golf ball, when compared with the two-piece golf ball, has better shot feel while maintaining excellent flight performance, because the three-piece golf ball can vary in hardness distribution.

The three-piece solid golf balls are obtained by inserting an intermediate layer between the core and the cover layer constituting the two-piece solid golf ball and have been described in Japanese Patent Kokai Publication Nos. 244174/1992, 10357/1997, 10358/1997, 117532/97, 313643/1997 and Japanese Patent Nos. 257587 and 2658811. In these golf balls, it has been attempted to compromise the balance of flight performance and shot feel at the time of hitting by using thermoplastic resin, such as a block copolymer of amides, polyester thermoplastic elastomer, ionomer resin, polyolefin, for the intermediate layer, to adjust the hardness of the core, intermediate layer and cover and the hardness distribution thereof to a proper range.

However, the golf ball having sufficient performances has not been obtained in view of the balance of flight performance and shot feel. Therefore, it is required to provide a golf ball having longer flight distance and better shot feel.

OBJECTS OF THE INVENTION

A main object of the present invention is to provide a multi-piece solid golf ball having excellent flight performance and good shot feel at the time of hitting.

According to the present invention, the object described above has been accomplished by placing an intermediate layer between at least one layer of center and an outer layer to make a multi-piece solid golf ball, and adjusting a hardness and hardness distribution of the center, a hardness difference between the center and the intermediate layer and the hardness difference between the intermediate layer and the outer layer to specified ranges, thereby providing a multi-piece solid golf ball having excellent flight performance and good shot feel at the time of hitting.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accomplishing drawings which are given by way of illustrating only, and thus are not limitative of the present invention, and wherein.

SUMMARY OF THE INVENTION

Figure 1:
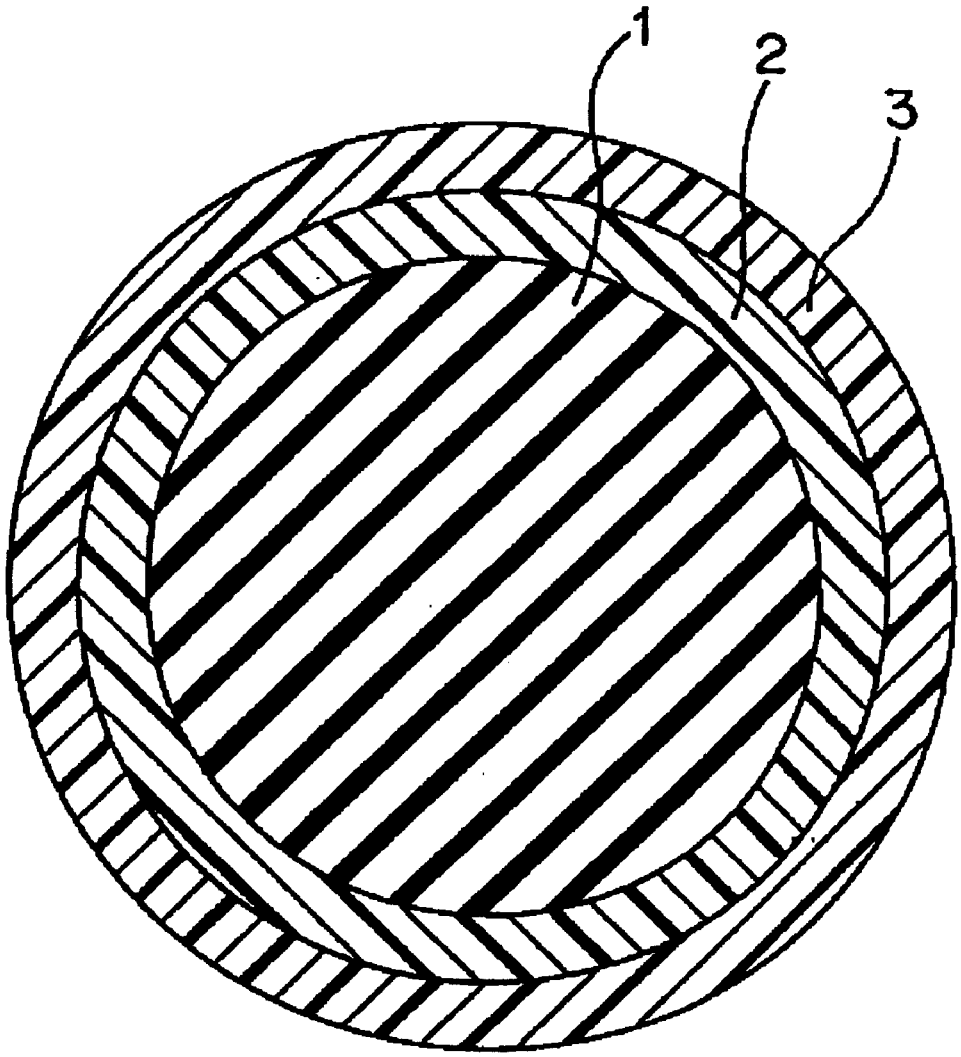
FIG. 1 is a schematic cross section illustrating one embodiment of the golf ball of the present invention.

The present invention provides a multi-piece solid golf ball comprising a center having at least one layer, an intermediate layer formed on the center, and an outer layer covering the intermediate layer, wherein the center has a JIS-C hardness of 65 to 85, the surface hardness of the center is higher than the central point hardness of the center by not more than 10; and the JIS-C hardness of the intermediate layer is lower than the surface hardness of the center by 0 to 10, and the JIS-C hardness of the outer layer is higher than the hardness of the intermediate layer by 15 to 40.

DETAILED DESCRIPTION OF THE INVENTION

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a center 1 and an intermediate layer 2 formed on the center 1, and an outer layer 3 covering the intermediate layer 2. The center 1 is formed from a rubber composition comprising a base rubber, a co-crosslinking agent, an organic peroxide, a filler, and optionally an antioxidant and the like.

The base rubber used in the present invention may be natural rubber and/or synthetic rubber, which have been conventionally used for solid golf balls. Preferred is high-cis polybutadiene rubber containing not less than 40%, preferably not less than 80% of a cis-1,4 bond. The high-cis polybutadiene rubber may be mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate because it imparts high rebound characteristics to the resulting golf ball. The amount of the co-crosslinking agent in the rubber composition is from 20 to 40 parts by weight, preferably from 25 to 35 parts by weight, based on 100 parts by weight of the base rubber. When the amount of the co-crosslinking agent is smaller than 20 parts by weight, the center is too soft, and the rebound characteristics are degraded, which reduces flight distance. On the other hand, when the amount of the co-crosslinking agent is larger than 40 parts by weight, the center is too hard, and shot feel is hard and poor.

The organic peroxide, which acts as a crosslinking agent or curing agent, includes, for example, dicumyl peroxide, 1,1-bis(t-butylperoxy)-3,3,5-trimethylcyclohexane, 2,5-dimethyl-2,5-di(t-butylperoxy)hexane, di-t-butyl peroxide and the like. The preferred organic peroxide is dicumyl peroxide. The amount of the organic peroxide is from 0.5 to 2.5 parts by weight, preferably 0.5 to 2.0 parts by weight, based on 100 parts by weight of the base rubber. When the amount of the organic peroxide is smaller than 0.5 parts by weight, the center is too soft, and the rebound characteristics are degraded, which reduces flight distance. On the other hand, when the amount of the organic peroxide is larger than 2.5 parts by weight, the center or the intermediate layer is too hard, and the shot feel is poor.

The filler used for the center 1 of the present invention, which can be typically used for the center of golf ball, includes for example, inorganic filler (such as zinc oxide, barium sulfate, calcium carbonate and the like), high specific gravity metal powder filler (such as tungsten powder, molybdenum powder and the like), and the mixture thereof.

The amount of the filler is from 5 to 60 parts by weight, preferably from 10 to 55 parts by weight, based on 100 parts by weight of the base rubber. When the amount of the filler is smaller than 5 parts by weight, the center is too light, and thus the resulting golf ball is too light. On the other hand, when the amount of the filler is larger than 60 parts by weight, the center is too heavy, and the resulting golf ball is too heavy.

The rubber composition for the center 1 of the golf ball of the present invention can contain other components, which have been conventionally used for preparing the core of solid golf balls, such as a peptizing agent or an antioxidant. If used, an amount of the antioxidant is preferably 0.2 to 1.5 parts by weight, based on 100 parts by weight of the base rubber.

The center 1 is obtained by mixing the above rubber composition, and then vulcanizing and press-molding the mixture in a mold. It is required that the center 1 of the golf ball of the present invention have a JIS-C hardness of 65 to 85, preferably 65 to 80, more preferably 65 to 75. When the hardness is lower than 65, the deformation amount at the time of hitting is too large, which reduces the flight distance. On the other hand, when the hardness is higher than 85, the center is too hard, the shot feel is hard and poor. It is required that the center 1 of the golf ball of the present invention has a difference between the surface hardness and central point hardness of not more than 10, preferably not more than 7. When the hardness difference is larger than 10, the central point hardness of the center 1 is too low, and the rebound characteristics are not sufficiently obtained and the shot feel is heavy and poor. The center 1 used for the golf ball of the present invention may have a multi-layered structure, which has two or more layers. If the center has a multi-layer structure, it is required that the center 1 has a difference between the surface hardness of the outmost layer and the central point hardness of not more than 10. The term "central point hardness of the center" as used herein refers to a hardness, which is obtained by cutting the center into two equal parts and then measuring the hardness at the center point.

It is desired that the center 1 of the golf ball of the present invention have a diameter of 34.5 to 37.5 mm, preferably 35 to 37 mm. When the diameter of the center 1 is smaller than 34.5 mm, the technical effect of heightening the rebound characteristics accomplished by the presence of the center is not sufficiently obtained. On the other hand, when the diameter is larger than 37.5 mm, the thickness of the intermediate layer is too thin, and the technical effects accomplished by the presence of the intermediate layer are not sufficiently obtained. The intermediate layer 2 is then formed on the center 1.

The material suitably used for the intermediate layer 2 of the present invention is not limited, but includes ionomer resin, polystyrene thermoplastic elastomer, polyurethane thermoplastic elastomer, polyamide thermoplastic elastomer, polyester thermoplastic elastomer, an SBS (styrene-butadiene-styrene) block copolymer having polybutadiene portion with epoxy groups or SIS (styrene-isoprene-styrene) block copolymer having polyisoprene portion with epoxy groups, thermoplastic elastomer having terminal OH groups, or combinations thereof. The ionomer resin may be a copolymer of α-olefin and α,β-unsaturated carboxylic acid having 3 to 8 carbon atoms, of which a portion of carboxylic acid groups is neutralized with metal ion. Examples of the α-olefins in the ionomer preferably include ethylene, propylene and the like. Examples of the α,β-unsaturated carboxylic acid in the ionomer preferably include acrylic acid, methacrylic acid and the like. The metal ion which neutralizes a portion of carboxylic acid groups of the copolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum, a neodymium ion and the like; and mixture thereof. Preferred are sodium ions, zinc ions, lithium ions and the like, in view of rebound characteristics, durability and the like. The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1705, Hi-milan 1706, Hi-milan 1707, Hi-milan 1855, Hi-milan 1856 and the like. Examples of the ionomer resins, which are commercially available from Du Pont Co., include Surlyn 9945, Surlyn 8945, Surlyn AD8511, Surlyn AD8512 and the like. Examples of the ionomer resins, which are commercially available from Exxon Chemical Co., include Iotek 7010, Iotek 8000 and the like. These ionomer resins may be used alone or in combination.

The composition of the intermediate layer used in the present invention may optionally contain fillers and the like, in addition to the resin component as main component. Examples of fillers include inorganic filler (such as zinc oxide, barium sulfate, calcium carbonate and the like), high specific gravity metal powder filler (such as tungsten powder, molybdenum powder and the like), and the mixture thereof.

A method of forming the intermediate layer 2 is not specifically limited, but may be a well-known method, which has been conventionally used for forming golf ball cover. For example, there can be used a method comprising molding the intermediate layer composition into a semi-spherical half-shell, covering the center with the two half-shells, followed by pressure molding, or a method comprising injection molding the intermediate layer composition directly on the center to cover it.

In the golf ball of the present invention, it is required that the JIS-C hardness of the intermediate layer 2 is lower than the surface hardness of the center 1 by 0 to 10, preferably 5 to 10. When the hardness difference is larger than 10, the golf ball does not deform at all, but it deforms only at the portion contacted with the club face of the golf club, and the contact area is large and the spin amount is large. Therefore the golf ball creates a blow-up trajectory, which reduces the flight distance. On the other hand, when the hardness difference is smaller than 0, that is, when the hardness of the intermediate layer is higher than the surface hardness of the center, the hardness of the outer portion of the golf ball is high, and the deformation amount of the golf ball is small when hit at low head speed and the launch angle is small, which reduces the flight distance.

It is desired that the intermediate layer 2 have a JIS-C hardness of 60 to 85, preferably 62 to 80. When the hardness is higher than 85, the shot feel is poor. On the other hand, when the hardness is lower than 60, the rebound characteristics are degraded. The term "hardness of the intermediate layer" as used herein refers to the surface hardness in JIS-C hardness of the molded article, which is obtained by covering the center 1 with the intermediate layer 2.

It is desired that the intermediate layer 2 of the golf ball of the present invention have a thickness of 1.0 to 1.8 mm, preferably 1.3 to 1.8 mm. When the thickness is smaller than 1.0 mm, the deformation amount of the golf ball at the time of hitting is small and the launch angle is small, which reduces the flight distance. On the other hand, when the thickness is larger than 1.8 mm, the golf ball deforms only at a portion contacted with a club face of a golf club, and the contact area is large and the spin amount is large. Therefore the golf ball creates blow-up trajectory, which reduces the flight distance. The outer layer 3 is then covered on the intermediate layer 2.

The material that can be used for the outer layer 3 of the present invention includes thermoplastic resin, particularly ionomer resin, which is the same as used for the intermediate layer 2, or mixtures thereof. As the materials used in the outer layer 3 of the present invention, the above ionomer resin may be used alone, but the ionomer resin may be suitably used in combination with thermoplastic elastomer or resin, which is the same as used for the intermediate layer 2.

The outer layer used in the present invention may optionally contain fillers (such as barium sulfate, calcium carbonate, etc.), pigments (such as titanium dioxide, etc.), and other additives such as a dispersant, an antioxidant, a UV absorber, a photostabilizer and fluorescent agent or fluorescent brightener, etc., in addition to the resin component as main component, as long as the addition of the additives does not deteriorate the desired performance of the outer layer of the golf ball. The amount of the pigment is preferably 0.1 to 0.5 parts by weight, based on 100 parts by weight of the resin component for the outer layer.

In the golf ball of the present invention, it is required that a JIS-C hardness of the outer layer 3 is higher than the hardness of the intermediate layer 2 by 15 to 40, preferably 19 to 37. When the hardness difference is larger than 40, the shot feel is heavy and is felt so that the golf ball stick to the club face of the golf club, and is poor. On the other hand, the hardness difference is smaller than 15, the shot feel is hard and poor. When the JIS-C hardness of the outer layer 3 is too low, the rebound characteristics are degraded. Therefore it is desired that the JIS-C hardness of the outer layer 3 is not less than 90, preferably not less than 95. When the JIS-C hardness of the outer layer 3 is too high, the shot feel is poor. Therefore it is desired that the JIS-C hardness of the outer layer 3 is 90 to 100, preferably 95 to 100. The term "hardness of the outer layer" as used herein refers to the surface hardness in JIS-C hardness of the golf ball, which is obtained by covering the intermediate layer 2 formed on the center 1 with the outer layer 3.

The outer layer 3 has a thickness of 1.5 to 2.3 mm, preferably 1.5 to 1.9 mm. When the thickness is smaller than 1.5 mm, the rebound characteristics are not sufficiently obtained, and the velocity of the golf ball is low. On the other hand, when the thickness is larger than 2.3 mm, the golf ball is too hard, and the launch angle is small.

A method of covering the intermediate layer with the outer layer 3 is not specifically limited, but may be the same method as used in the intermediate layer. At the time of molding the outer layer, many depressions called "dimples" may be optionally formed on the surface of the golf ball. Furthermore, paint finishing or marking with a stamp may be optionally provided after the outer layer is molded for commercial purpose. The multi-piece solid golf ball of the present invention is formed, so that it has a diameter of not less than 42.67 mm and a weight of not more than 45.93 g, according to the PGA rule.

EXAMPLES

The following Examples and Comparative Examples further illustrate the present invention in detail but are not to be construed to limit the scope of the present invention.

(Examples 1 to 8 and Comparative Examples 1 to 7)

Production of Center

The rubber compositions for the center shown in Table 1 (Examples) and Table 2 (Comparative Examples) were mixed with a mixing roll, and then vulcanized by press-molding at the vulcanization condition shown in the same Tables to obtain spherical centers. The central point hardness A, surface hardness B and diameter of the resulting centers were measured, and the hardness difference (B-A) was calculated. The results are shown in Tables 5 and 6 (Examples) and Tables 7 and 8 (Comparative Examples). The test methods are described later.

TABLE 1

| | Example No. | | | | | | | |
|---|---|---|---|---|---|---|---|---|
| | 1 | 2 | 3 | 4 | 5 | 6 | 7 | 8 |
| Center composition | | | | | | | | |
| BR18*1 | 100 | 100 | 100 | 100 | 100 | 100 | 100 | 100 |
| Zinc acrylate | 26 | 26 | 26 | 26 | 33 | 26 | 26 | 26 |
| Zinc oxide | 22.2 | 22.2 | 24.1 | 22.2 | 19.9 | 24.7 | 28.0 | 31.9 |
| Barium sulfate | 10 | 10 | 10 | 10 | 10 | 10 | 10 | 10 |
| Dicumyl peroxide | 0.6 | 0.6 | 0.6 | 0.6 | 0.6 | 0.6 | 0.6 | 0.6 |
| Diphenyl disulfide | 1.0 | 1.0 | 1.0 | 1.0 | 1.0 | 1.0 | 1.0 | 1.0 |
| Vulcanization condition | | | | | | | | |
| The first stage | | | | | | | | |
| Temp. (° C.) | 145 | 155 | 155 | 145 | 160 | 150 | 150 | 150 |
| Time (min) | 22 | 26 | 26 | 22 | 26 | 22 | 22 | 22 |
| The second stage | | | | | | | | |
| Temp. (° C.) | 165 | — | — | 165 | — | 165 | 165 | 165 |
| Time (min) | 8 | — | — | 8 | — | 8 | 8 | 8 |

TABLE 2

| | Comparative Example No. | | | | | | |
|---|---|---|---|---|---|---|---|
| | 1 | 2 | 3 | 4 | 5 | 6 | 7 |
| Center composition | | | | | | | |
| BR18*1 | 100 | 100 | 100 | 100 | 100 | 100 | 100 |
| Zinc acrylate | 25 | 31 | 26 | 33 | 22.2 | 26 | 33 |
| Zinc oxide | 22.5 | 19.0 | 10.6 | 19.9 | 15.6 | 22.2 | 19.9 |
| Barium sulfate | 10 | 10 | 10 | 10 | 10 | 10 | 10 |
| Dicumyl peroxide | 0.6 | 0.6 | 0.6 | 0.6 | 0.6 | 0.6 | 0.6 |
| Diphenyl disulfide | 1.0 | 1.0 | 1.0 | 1.0 | 1.0 | 1.0 | 1.0 |
| Vulcanization condition | | | | | | | |
| The first stage | | | | | | | |
| Temp. (° C.) | 160 | 165 | 150 | 145 | 145 | 145 | 160 |
| Time (min) | 26 | 26 | 22 | 22 | 22 | 22 | 26 |
| The second stage | | | | | | | |
| Temp. (° C.) | — | — | 165 | 165 | 165 | 165 | — |
| Time (min) | — | — | 8 | 8 | 8 | 8 | — |

*1 High-cis Polybutadiene rubber (trade name "BR18") available from JSR Co., Ltd.

Preparation of Intermediate Layer and Outer Layer Compositions

The formulation materials shown in Table 3 (Examples) and Table 4 (Comparative Examples) were mixed using a kneading type twin-screw extruder to obtain pelletized intermediate layer and outer layer compositions.

The extrusion condition was, a screw diameter of 45 mm, a screw speed of 200 rpm, and a screw L/D of 35.

The formulation materials were heated at 200 to 260° C. at the die position of the extruder.

TABLE 3

| | Example No. | | | | | | | |
|---|---|---|---|---|---|---|---|---|
| | 1 | 2 | 3 | 4 | 5 | 6 | 7 | 8 |
| Intermediate layer composition | | | | | | | | |
| Surlyn 9945*2 | 10 | 10 | 10 | 20 | 30 | 10 | 10 | 10 |
| Surlyn 8945*3 | 10 | 10 | 10 | 20 | 30 | 10 | 10 | 10 |
| Septon HG-252*4 | 80 | 80 | 80 | 60 | 40 | 80 | 80 | 80 |
| Elastoran ET880*5 | — | — | — | — | — | — | — | — |
| Hi-milan 1855*6 | — | — | — | — | — | — | — | — |
| Pebax 2533S*7 | — | — | — | — | — | — | — | — |
| Epofriend A1010*8 | — | — | — | — | — | — | — | — |
| Outer layer composition | | | | | | | | |
| Hi-milan 1605*9 | 60 | 60 | 60 | 60 | 60 | 60 | 60 | 60 |
| Hi-milan 1706*10 | 40 | 40 | 40 | 40 | 40 | 40 | 40 | 40 |
| Surlyn 9945*2 | — | — | — | — | — | — | — | — |
| Surlyn 8945*3 | — | — | — | — | — | — | — | — |
| Hi-milan 1855*6 | — | — | — | — | — | — | — | — |
| Pebax 2533S*7 | — | — | — | — | — | — | — | — |
| Epofriend A1010*8 | — | — | — | — | — | — | — | — |
| Titanium dioxide | 0.2 | 0.2 | 0.2 | 0.2 | 0.2 | 0.2 | 0.2 | 0.2 |
| Barium sulfate | 0.2 | 0.2 | 0.2 | 0.2 | 0.2 | 0.2 | 0.2 | 0.2 |
| Antioxidant*11 | 0.02 | 0.02 | 0.02 | 0.02 | 0.02 | 0.02 | 0.02 | 0.02 |

TABLE 4

| | Comparative Example No. | | | | | | |
|---|---|---|---|---|---|---|---|
| | 1 | 2 | 3 | 4 | 5 | 6 | 7 |
| Outer layer composition | | | | | | | |
| Surlyn 9945*2 | 10 | 10 | — | 30 | 37 | 30 | 40 |
| Surlyn 8945*3 | 10 | 10 | — | 30 | 46 | 30 | 40 |
| Septon HG-252*4 | 80 | 80 | — | 40 | — | 40 | 20 |
| Elastoran ET880*5 | — | — | 100 | — | — | — | — |
| Hi-milan 1855*6 | — | — | — | — | 10 | — | — |
| Pebax 2533S*7 | — | — | — | — | 5 | — | — |
| Epofriend A1010*8 | — | — | — | — | 2 | — | — |
| Outer layer composition | | | | | | | |
| Hi-milan 1605*9 | 60 | 60 | 60 | 60 | 60 | 60 | — |
| Hi-milan 1706*10 | 40 | 40 | 40 | 40 | 40 | 40 | — |
| Surlyn 9945*2 | — | — | — | — | — | — | 37 |
| Surlyn 8945*3 | — | — | — | — | — | — | 46 |
| Hi-milan 1855*6 | — | — | — | — | — | — | 10 |
| Pebax 2533S*7 | — | — | — | — | — | — | 5 |
| Epofriend A1010*8 | — | — | — | — | — | — | 2 |
| Titanium dioxide | 0.2 | 0.2 | 0.2 | 0.2 | 0.2 | 0.2 | 0.2 |
| Barium sulfate | 0.2 | 0.2 | 0.2 | 0.2 | 0.2 | 0.2 | 0.2 |
| Antioxidant*11 | 0.02 | 0.02 | 0.02 | 0.02 | 0.02 | 0.02 | 0.02 |

*2 Surlyn 9945 (trade name), ethylene-methacrylic acid copolymer ionomer resin obtained by neutralizing with zinc ion, manufactured by DuPont Co.
*3 Surlyn 8945 (trade name), ethylene-methacrylic acid copolymer ionomer resin obtained by neutralizing with sodium ion, manufactured by DuPont Co.
*4 Septon HG-252 (trade name), hydrogenated styrene-isoprene-styrene (SIS) block copolymer having a terminal OH group, manufactured by Kuraray Co. Ltd.

TABLE 4-continued

| | Comparative Example No. | | | | | | |
|---|---|---|---|---|---|---|---|
| | 1 | 2 | 3 | 4 | 5 | 6 | 7 |

*5 Polyurethane elastomer (trade name "Elastoran ET880") available from Takeda Verdishe Urethane Industries, Ltd.
*6 Hi-milan 1855 (trade name), ethylene-methacrylic acid-isobutyl acrylate terpolymer ionomer resin obtained by neutralizing with zinc ion, manufactured by Mitsui DuPont Polychemical Co., Ltd.
*7 Pebax 2533S (trade name), polyamide thermoplastic elastomer, manufactured by ELF Atochem Co.
*8 Epofriend AT1010 (trade name), styrene-butadiene-styrene (SBS) block copolymer with epoxy groups, manufactured by Daicel Chemical Industries, Ltd., JIS-A hardness = 67, styrene/butadiene (weight ratio) = 40/60, content of epoxy = about 1.5 to 1.7% by weight
*9 Hi-milan 1605 (trade name), ethylene-methacrylic acid copolymer ionomer resin obtained by neutralizing with sodium ion, manufactured by Mitsui DuPont Polychemical Co., Ltd.
*10 Hi-milan 1706 (trade name), ethylene-methacrylic acid copolymer ionomer resin obtained by neutralizing with zinc ion, manufactured by Mitsui DuPont Polychemical Co., Ltd.
*11 Sanol LS770 (trade name), antioxidant manufactured by Sankyo Co., Ltd.

Formation of Intermediate Layer

The compositions for the intermediate layer were injection molded on the center to form the intermediate layer. The JIS-C hardness C and thickness of the intermediate layer were measured, and the hardness difference (B-C) was calculated. The results are shown in Tables 5 and 6 (Examples) and Tables 7 and 8 (Comparative Examples).

Production of Golf Ball

The compositions for the outer layer were covered on the intermediate layer by injection molding to form the outer layer. The JIS-C hardness D and thickness of the resulting outer layer were measured, and the hardness difference (D-C) was calculated. The results are shown in Tables 5 and 6 (Examples) and Tables 7 and 8 (Comparative Examples). Then, deflashing, surface pretreatment for painting, paint and the like, which are generally done on the surface of a golf ball, were conducted on the surface to produce a golf ball having a diameter of 42.7 mm. With respect to the resulting golf balls, the flight performance and shot feel were evaluated. The results are shown in Tables 5 and 6 (Examples) and Tables 7 and 8 (Comparative Examples). As the flight performance, launch angle, spin amount and flight distance (carry). The test methods are as follows.

(Test Method)

(1) Flight Performance

A No. 1 wood club (W#1, a driver) was mounted to a swing robot manufactured by True Temper Co. and the golf ball was hit at a head speed of 40 m/second, the launch angle, flight distance and spin amount were measured. As the flight distance, carry that is a distance to the dropping point of the hit golf ball was measured. The spin amount was measured by continuously taking a photograph of a mark provided on the hit golf ball using a high-speed camera.

(2) Shot Feel

The shot feel of the golf ball is evaluated by 10 golfers according to a practical hitting test using a No. 1 wood club. The evaluation criteria are as follows.

Evaluation criteria:

○: Not less than 7 out of 10 golfers felt that the golf ball has soft and good shot feel.

Δ: From 4 to 6 out of 10 golfers felt that the golf ball has soft and good shot feel.

XW: Not less than 7 out of 10 golfers felt that the golf ball has slightly heavy and poor shot feel.

XWW: Not less than 7 out of 10 golfers felt that the golf ball has heavy and poor shot feel.

XH: Not less than 7 out of 10 golfers felt that the golf ball has hard and poor shot feel.

TABLE 5

| | Example No. | | | |
|---|---|---|---|---|
| | 1 | 2 | 3 | 4 |
| | (Center) | | | |
| JIS-C hardness | | | | |
| Central point hardness (A) | 71 | 65 | 65 | 71 |
| Surface hardness (B) | 72 | 72 | 72 | 72 |
| Hardness difference (B − A) | 1 | 7 | 7 | 1 |
| Diameter (mm) | 36.4 | 36.4 | 36.0 | 36.4 |
| | (Intermediate layer) | | | |
| Hardness (C) (JIS-C) | 62 | 62 | 62 | 71 |
| Hardness difference (B − C) | 10 | 10 | 10 | 1 |
| Thickness (mm) | 1.6 | 1.6 | 1.8 | 1.6 |
| | (Outer layer) | | | |
| Hardness (D) (JIS-C) | 99 | 99 | 99 | 99 |
| Hardness difference (D − C) | 37 | 37 | 37 | 28 |
| Thickness (mm) | 1.55 | 1.55 | 1.55 | 1.55 |
| | (Golf ball) | | | |
| Flight performance | | | | |
| Launch angle (degree) | 12.8 | 12.9 | 12.7 | 12.6 |
| Spin amount (rpm) | 2785 | 2690 | 2790 | 2810 |
| Carry (yard) | 197.4 | 198.6 | 197.9 | 196.8 |
| Shot feel | ○ | ○ | ○ | ○ |

TABLE 6

| | Example No. | | | |
|---|---|---|---|---|
| | 5 | 6 | 7 | 8 |
| | (Center) | | | |
| JIS-C hardness | | | | |
| Central point hardness (A) | 75 | 68 | 68 | 68 |
| Surface hardness (B) | 85 | 72 | 72 | 72 |
| Hardness difference (B − A) | 10 | 4 | 4 | 4 |
| Diameter (mm) | 36.4 | 35.8 | 35.3 | 34.5 |
| | (Intermediate layer) | | | |
| Hardness (C) (JIS-C) | 80 | 62 | 62 | 62 |
| Hardness difference (B − C) | 5 | 10 | 10 | 10 |
| Thickness (mm) | 1.6 | 1.6 | 1.6 | 1.6 |
| | (Outer layer) | | | |
| Hardness (D) (JIS-C) | 99 | 99 | 99 | 99 |
| Hardness difference (D − C) | 19 | 37 | 37 | 37 |
| Thickness (mm) | 1.55 | 1.85 | 2.10 | 2.50 |
| | (Golf ball) | | | |
| Flight performance | | | | |
| Launch angle (degree) | 12.85 | 12.75 | 12.7 | 12.6 |
| Spin amount (rpm) | 2710 | 2750 | 2740 | 2820 |
| Carry (yard) | 198.3 | 197.5 | 197.3 | 196.9 |
| Shot feel | ○ | ○ | ○ | ○ |

TABLE 7

| | Comparative Example No. | | | |
|---|---|---|---|---|
| | 1 | 2 | 3 | 4 |
| | (Center) | | | |
| JIS-C hardness | | | | |
| Central point hardness (A) | 60 | 65 | 68 | 85 |
| Surface hardness (B) | 70 | 80 | 72 | 88 |
| Hardness difference (B − A) | 10 | 15 | 4 | 3 |
| Diameter (mm) | 36.4 | 36.4 | 36.4 | 36.4 |
| | (Intermediate layer) | | | |
| Hardness (C) (JIS-C) | 62 | 62 | 55 | 80 |
| Hardness difference (B − C) | 8 | 18 | 17 | 8 |
| Thickness (mm) | 1.6 | 1.6 | 1.6 | 1.6 |
| | (Outer layer) | | | |
| Hardness (D) (JIS-C) | 99 | 99 | 99 | 99 |
| Hardness difference (D − C) | 37 | 37 | 44 | 19 |
| Thickness (mm) | 1.55 | 1.55 | 1.55 | 1.55 |
| | (Golf ball) | | | |
| Flight performance | | | | |
| Launch angle (degree) | 12.8 | 12.9 | 12.4 | 12.5 |
| Spin amount (rpm) | 2690 | 2650 | 2850 | 2820 |
| Carry (yard) | 194.1 | 194.5 | 195.3 | 196.7 |
| Shot feel | ×WW | ×W | ×WW | ×H |

TABLE 8

| | Comparative Example No. | | |
|---|---|---|---|
| | 5 | 6 | 7 |
| | (Center) | | |
| JIS-C hardness | | | |
| Central point hardness (A) | 71 | 71 | 75 |
| Surface hardness (B) | 72 | 72 | 85 |
| Hardness difference (B − A) | 1 | 1 | 10 |
| Diameter (mm) | 36.4 | 36.4 | 36.4 |
| | (Intermediate layer) | | |
| Hardness (C) (JIS-C) | 95 | 80 | 89 |
| Hardness difference (B − C) | −23 | −7 | −4 |
| Thickness (mm) | 1.6 | 1.6 | 1.6 |
| | (Outer layer) | | |
| Hardness (D) (JIS-C) | 99 | 99 | 95 |
| Hardness difference (D − C) | 4 | 19 | 6 |
| Thickness (mm) | 1.55 | 1.55 | 1.55 |
| | (Golf ball) | | |
| Flight performance | | | |
| Launch angle (degree) | 12.45 | 12.4 | 12.6 |
| Spin amount (rpm) | 2830 | 2760 | 2800 |
| Carry (yard) | 196.3 | 196.5 | 195.3 |
| Shot feel | ×H | Δ | Δ |

As is apparent from Tables 5 to 8, the multi-piece solid golf balls of Examples 1 to 8 had longer flight distance when hit by a driver and better shot feel than the conventional golf balls of Comparative Examples 1 to 7.

On the other hand, in the golf ball of Comparative Example 1, the deformation amount at the time of hitting is too large, and the flight distance is small, because the central point hardness of the center is low. In the golf ball of Comparative Example 2, the central point hardness of the center is too low, and the rebound characteristics are degraded, which reduces the flight distance, and the shot feel at the time of hitting is heavy and poor, because the difference between the surface hardness and the central point hardness of the center is large. In addition, since the hardness difference between the intermediate layer and the surface of the center is large, the golf ball does not deforms at all portion thereof, but it deforms only at a portion contacted with a club face of a golf club, and the contact area is large and the spin amount is large. Therefore the golf ball creates blow-up trajectory, which reduces the flight distance.

In the golf ball of Comparative Example 3, the contact area contacted with a club face of a golf club is large, and the spin amount is large and the golf ball creates blow-up trajectory, which reduces flight distance, because the hardness difference between the intermediate layer and the surface of the center is large. The shot feel is heavy and poor, because the hardness difference between the outer layer and the intermediate layer is large.

In the golf ball of Comparative Example 4, the shot feel is hard and poor, because the surface hardness of the center is large. In the golf ball of Comparative Example 5, the shot feel is hard and poor, because the hardness difference between the outer layer and the intermediate layer is small. In addition, since the hardness of the intermediate layer is higher than the surface hardness of the center, the hardness of an outer portion of the golf ball is high, and the deformation amount of the golf ball is small and the launch angle is small, which reduces the flight distance.

In the golf ball of Comparative Example 6, since the hardness of the intermediate layer is higher than the surface hardness of the center, the hardness of an outer portion of the golf ball is high, and the deformation amount of the golf ball is small and the launch angle is small, which reduces the flight distance. In the golf ball of Comparative Example 7, since the hardness of the intermediate layer is higher than the surface hardness of the center, the hardness of an outer portion of the golf ball is high, and the deformation amount of the golf ball is small and the launch angle is small, which reduces the flight distance. In addition, the shot feel is hard and poor, because the hardness difference between the outer layer and the intermediate layer is small.

What is claimed is:

1. A multi-piece solid golf ball comprising a center having at least one layer, an intermediate layer formed on the center, and an outer layer covering the intermediate layer, wherein the center has a JIS-C hardness of 65 to 85, a surface hardness of the center is higher than a central point hardness of the center by not more than 10, a JIS-C hardness of the intermediate layer is lower than the surface hardness of the center by 0 to 10, a JIS-C hardness of the outer layer is higher than the hardness of the intermediate layer by 15 to 40.

2. The golf ball according to claim 1, wherein the intermediate layer has a thickness of 1.0 to 1.8 mm, and the outer layer has a thickness of 1.5 to 2.3 mm.

3. The golf ball according to claim 1, wherein the center has a diameter of 34.5 to 37.5 mm.

4. The golf ball according to claim 1, wherein the center is formed a rubber composition, and the intermediate layer and the outer layer are formed from thermoplastic resin.

5. The golf ball according to claim 1, wherein the center has a JIS-C hardness of 65 to 80.

6. The golf ball according to claim 1, wherein the surface hardness of the center is higher than the central point hardness of the center by not more than 7.

7. The golf ball according to claim 1, wherein the JIS-C hardness of the intermediate layer is lower than the surface hardness of the center by 5 to 10.

8. The golf ball according to claim 1, wherein the JIS-C hardness of the outer layer is higher than the hardness of the intermediate layer by 19 to 37.

* * * * *